US010753665B2

(12) United States Patent
Saito et al.

(10) Patent No.: US 10,753,665 B2
(45) Date of Patent: Aug. 25, 2020

(54) ICE MAKING DEVICE

(71) Applicant: NIDEC SANKYO CORPORATION, Nagano (JP)

(72) Inventors: Shunji Saito, Nagano (JP); Satoshi Tanimura, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 69 days.

(21) Appl. No.: 16/116,939

(22) Filed: Aug. 30, 2018

(65) Prior Publication Data

US 2019/0063810 A1 Feb. 28, 2019

(30) Foreign Application Priority Data

Aug. 31, 2017 (JP) ..... 2017-166787
Mar. 9, 2018 (JP) ..... 2018-042945

(51) Int. Cl.

| | |
|---|---|
| ***F25C 1/10*** | (2006.01) |
| ***F25C 1/22*** | (2018.01) |
| ***F25C 1/04*** | (2018.01) |
| ***F25C 5/06*** | (2006.01) |

(52) U.S. Cl.

CPC ..... *F25C 1/10* (2013.01); *F25C 1/04* (2013.01); *F25C 1/22* (2013.01); *F25C 5/06* (2013.01); *F25C 2305/022* (2013.01); *F25C 2600/04* (2013.01); *F25C 2700/12* (2013.01); *F25C 2700/14* (2013.01)

(58) Field of Classification Search

CPC ..... F25C 2700/12; F25C 2600/04; F25C 2305/022; F25C 1/10; F25C 5/06; F25C 1/24

See application file for complete search history.

(56) References Cited

U.S. PATENT DOCUMENTS 4,142,377 A * 3/1979 Fogt ..... F25C 1/04 62/135
4,265,089 A * 5/1981 Webb ..... F25C 1/04 280/801.2

(Continued)

FOREIGN PATENT DOCUMENTS

JP 06249557 A * 9/1994
JP 07218063 A * 8/1995

(Continued)

OTHER PUBLICATIONS

Office Action of China Counterpart Application, with English translation thereof, dated Jun. 1, 2020, pp. 1-19.

*Primary Examiner* — Kun Kai Ma
(74) *Attorney, Agent, or Firm* — JCIPRNET

(57) ABSTRACT

An ice making device is provided. In an ice making device, a convex part reflecting the shape of a recessed part for water storage is formed on a bottom surface of the ice making tray. A temperature sensor is in contact with a side wall of the convex part. The temperature sensor is covered with a flexible member. In addition, a cover member pressing the temperature sensor against the ice making tray is fixed to the bottom surface of the ice making tray through the flexible member. In the temperature sensor, a sealing coating layer is provided to cover a temperature detection chip, but an exterior case is not used.

18 Claims, 12 Drawing Sheets

(56) References Cited

U.S. PATENT DOCUMENTS

| | | | | | |
|---|---|---|---|---|---|
| 5,182,916 | A * | 2/1993 | Oike | F25C 1/04 | 62/135 |
| 6,092,925 | A * | 7/2000 | Nojiri | F25D 21/02 | 374/16 |
| 2009/0296773 | A1* | 12/2009 | Sattler | G01K 1/16 | 374/100 |
| 2015/0338146 | A1* | 11/2015 | Keller | F25C 1/04 | 62/139 |
| 2016/0116199 | A1* | 4/2016 | Fischer | F25C 5/185 | 62/344 |
| 2017/0299244 | A1* | 10/2017 | Alshourbagy | F25C 5/22 | |
| 2019/0041112 | A1* | 2/2019 | Chatelle | F25C 1/10 | |
| 2019/0078824 | A1* | 3/2019 | Yun | F25C 1/10 | |

FOREIGN PATENT DOCUMENTS

| | | | |
|---|---|---|---|
| JP | 2005024172 | A * | 1/2005 |
| JP | 2012255579 | | 12/2012 |

* cited by examiner

ICE MAKING DEVICE

CROSS-REFERENCE TO RELATED APPLICATION

This application claims the priority of Japan patent applications serial no. 2017-166787, filed on Aug. 31, 2017 and no. 2018-042945, filed on Mar. 9, 2018. The entirety of each of the above-mentioned patent applications are hereby incorporated by reference herein and made a part of this specification.

BACKGROUND

Technical Field

The disclosure relates to an ice making device including a temperature sensor configured to monitor a temperature of a liquid filled into an ice making tray.

Related Art

An ice making device mounted on a refrigerator includes an ice making tray in which recessed parts for water storage are disposed upward, and a thermistor as a temperature sensor (temperature measuring unit) is provided on a bottom surface of the ice making tray. In the ice making device, water in a water supply tank is filled into the recessed parts for water storage of the ice making tray through a water supply pipe, and a temperature of water filled into the recessed parts for water storage is then monitored by the thermistor. When it is determined that ice making is completed based on monitoring results by the thermistor, the ice making tray is inverted around a horizontal axis and twisted by the drive unit, and ice falls into the ice storage container (refer to Japanese Laid-open publication No. 2012-255579). On a bottom surface of the ice making tray used for the ice making device described in Japanese Laid-open publication No. 2012-255579, a plurality of convex parts reflecting the shape of the recessed parts for water storage are formed, and a thermistor is disposed in the groove-like recessed part formed between the plurality of convex parts. In the thermistor, a thermistor element is inserted into a cylindrical head cover (exterior case) and a gap in the head cover is filled with a sealing resin. When the thermistor is provided on the bottom surface of the ice making tray, a structure in which the thermistor is covered with a thermistor protection sealer, and additionally, the thermistor protection sealer is covered with a thermistor cover is used.

The thermistor described in Japanese Laid-open publication No. 2012-255579 has a structure in which a gap in the head cover is filled with a sealing resin while the thermistor element is inserted into the cylindrical head cover. Therefore, the cost of the thermistor increases. In addition, the size of the thermistor is large because the thermistor element is inserted into the cylindrical head cover. Accordingly, when the thermistor is disposed in the groove-like recessed part formed on the bottom surface of the ice making tray, there are problems that the width of the groove-like recessed part needs to be wider and the like. In addition, when the size of the thermistor is large, it is not easy to cover the thermistor with a thermistor protection sealer.

SUMMARY

An ice making device according to the disclosure includes an ice making tray in which at least one recessed part for water storage is disposed upward; a drive unit that causes the ice making tray to perform an inversion operation and a twist operation around an axis that extends in a direction crossing a vertical direction; a frame that supports the ice making tray and the drive unit; a temperature sensor that is disposed to be in contact with a bottom surface of the ice making tray, wherein a sealing coating layer covering a chip for a temperature detection is not covered with an exterior case and is exposed; and a flexible member covering the temperature sensor.

DESCRIPTION OF THE EMBODIMENTS

Figure 1:
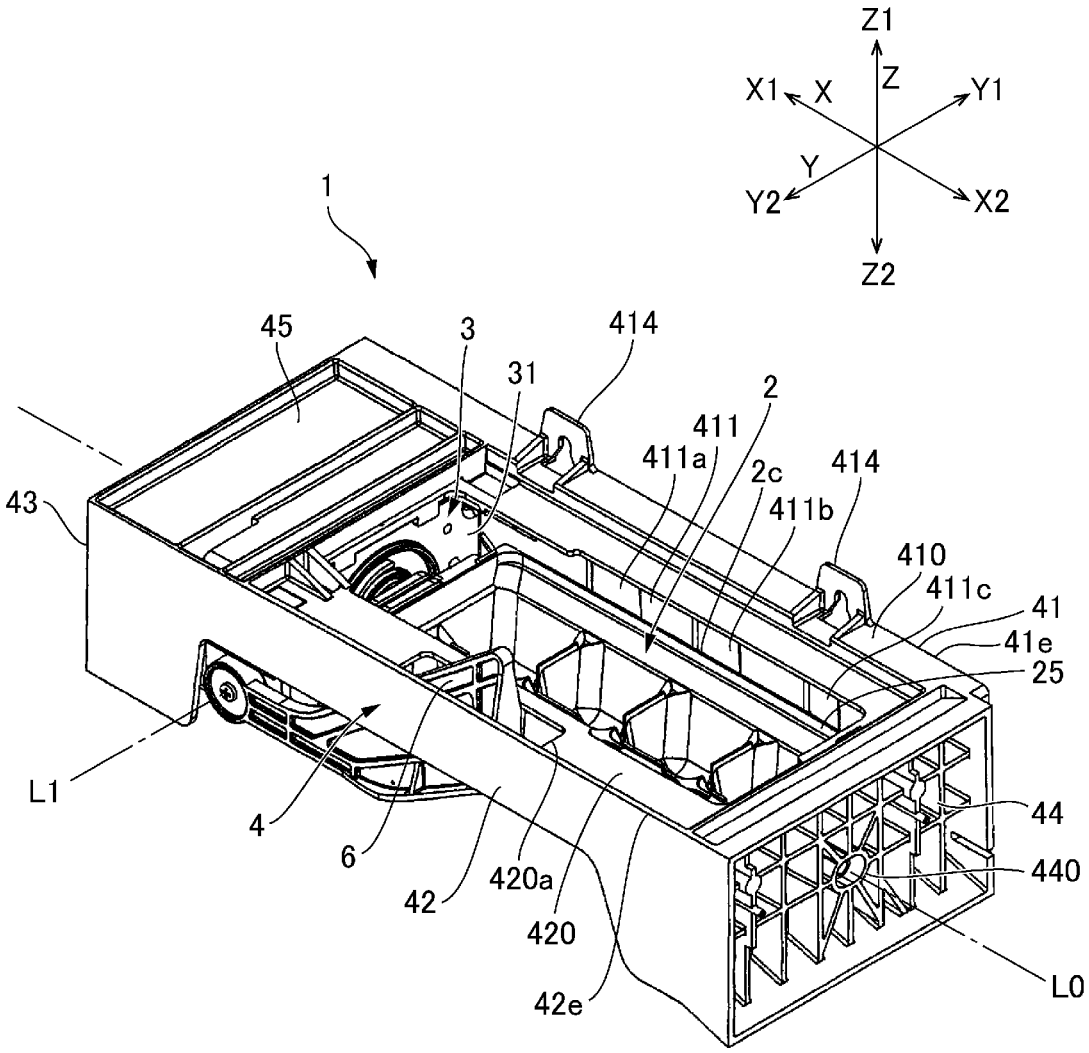
FIG. 1 is a perspective view of an ice making device to which the disclosure is applied when viewed from the side on which a second side plate is disposed and viewed obliquely from above.

The disclosure is to provide an ice making device in which a temperature sensor that is inexpensive and has a small size is provided on a bottom surface side of an ice making tray.

In the disclosure, in the temperature sensor, the sealing coating layer covering the temperature detection chip is not covered with the exterior case but is exposed. That is, in the temperature sensor, the sealing coating layer is provided to cover the temperature detection chip, but the exterior case is not used. Accordingly, it is possible to reduce the cost of the temperature sensor and reduce the size of the temperature sensor. In addition, when the size of the temperature sensor is reduced, it is possible to alleviate restriction of a position at which the temperature sensor is provided in the ice making tray and the like. In addition, since the temperature sensor is covered with a flexible member, cold air does not easily directly reach the temperature sensor. Accordingly, the temperature sensor can appropriately monitor a temperature of water filled into the recessed parts for water storage and the like. In addition, when the size of the temperature sensor is reduced, the temperature sensor is appropriately easily covered with the flexible member.

In the disclosure, a sheet-like or plate-like heat insulating member can be used as the flexible member. According to this aspect, since the flexible member is the heat insulating member, the temperature sensor can appropriately monitor a temperature of water filled into the recessed parts for water storage and the like without being influenced by a temperature in the ice making room. In the disclosure, a porous member can be used as the heat insulating member.

In the disclosure, a surface of the flexible member on a side of the ice making tray can have adhesiveness. According to this aspect, the temperature sensor can be fixed to the ice making tray by the flexible member.

In the disclosure, the temperature sensor can be a thermistor, and the chip can be a thermistor element chip.

In the disclosure, a cover member can be included. The cover is fixed to the bottom surface of the ice making tray so that the temperature sensor is pressed against the ice making tray through the flexible member. According to this aspect, the temperature sensor can be reliably brought into contact with the ice making tray. In addition, since the flexible member and the temperature sensor can be fixed to the ice making tray by the cover member, it is possible to prevent the flexible member and the temperature sensor from falling off of the ice making tray.

In the disclosure, in the ice making tray, the at least one recessed part for water storage is a plurality of recessed parts for water storage and are arranged along the axis and along a width direction crossing the axis. On the bottom surface of the ice making tray, a plurality of convex parts reflecting shape of the recessed parts for water storage are formed. The temperature sensor is disposed in one of the plurality of convex parts inside groove-like recessed parts formed between the plurality of convex parts to be in contact with a first side wall that faces a direction crossing the vertical direction. According to this aspect, since the size of the temperature sensor is large, even if the width of the groove-like recessed part is not widened, the temperature sensor can be disposed at an appropriate position. In addition, even if the temperature sensor, the flexible member, and the cover member are provided on the side of the bottom surface of the ice making tray, since the temperature sensor with a small size is disposed in the groove-like recessed part, it is possible to prevent the cover member from largely protruding from the side of the bottom surface of the ice making tray.

In the disclosure, the first side wall faces the width direction can be used. According to this aspect, when the ice making tray is twisted, since a large force is not applied to the temperature sensor, it is possible to prevent the temperature sensor from falling off of the ice making tray.

In the disclosure, the ice making tray includes a first engaged part that protrudes from a bottom wall of the one convex part and a second engaged part that faces the first side wall in the width direction and protrudes from a bottom wall of an adjacent convex part adjacent to the one convex part. The flexible member is provided so that it overlaps the bottom wall of the one convex part and the first side wall. The cover member includes an end plate that overlaps the bottom wall of the one convex part through the flexible member, a first plate that protrudes from an intermediate position on the end plate in the width direction into the groove-like recessed part and overlaps the first side wall through the flexible member, a first engagement part that is provided at an end on one side of the end plate, which refers to a side on which the first engaged part is disposed in the width direction, to be locked to the first engaged part, and a second engagement part that is disposed at an end on an other side of the end plate, which refers a side on which the second engaged part is disposed in the width direction, to be locked to the second engaged part. According to this aspect, the cover member is easily fixed to the ice making tray.

In the disclosure, the first engaged part and the second engaged part each have an engagement hole that penetrates in the width direction. The first engagement part is a first engagement shaft that protrudes from an end surface on the one side of the end plate along the end plate in the width direction. The second engagement part is a second engagement shaft that protrudes from an end surface on the other side of the end plate along the end plate in the width direction. An interval between the first engaged part and the second engaged part in the width direction is narrower than or equal to a length of the end plate in the width direction. While the first engagement shaft is inserted into the engagement hole of the first engaged part and the second engagement shaft is inserted into an engagement hole of the second engaged part, an end surface on the one side of the end plate comes in contact with the first engaged part, and an end surface on the other side comes in contact with the second engaged part. According to this aspect, when the first engagement shaft of the cover member is inserted into the engagement hole of the first engaged part and the second engagement shaft of the cover member is inserted into the engagement hole of the second engaged part, the cover member can be fixed to the ice making tray. In addition, since the engagement parts provided in the cover member are shaft parts that protrude in the width direction along end plates, even if a locking part is provided, it is possible to reduce a protrusion amount of the cover member that protrudes from a bottom wall of one convex part.

In the disclosure, in the end plate, in an end plate part on the other side relative to the first plate, a gap that extends in a direction along the axis is provided, wherein the second engagement shaft and the gap overlap when viewed in the width direction. An end on the other side relative to the gap of the end plate is elastically deformable in the width direction. In this manner, while an end on the other side relative to the gap of the end plate is elastically deformed after the first engagement shaft of the cover member is inserted into the engagement hole of the first engaged part, the second engagement shaft of the cover member can be inserted into the engagement hole of the second engaged part. Accordingly, the cover member is easily fixed to the ice making tray.

In the disclosure, an interval between the first engaged part and the second engaged part is narrower than the length of the end plate in the width direction. While the first engagement shaft is inserted into the engagement hole of the first engaged part and the second engagement shaft is inserted into the engagement hole of the second engaged part, the end on the other side of the end plate is elastically deformed. According to this aspect, an elastic restoring force of an end of the end plate acts as a force with which the first plate is pressed against the first side wall of the convex part. Accordingly, the temperature sensor can be brought into contact with the ice making tray more reliably.

In the disclosure, the cover member includes a reinforcing plate that protrudes from an end plate part on the other side relative to the first plate in the end plate into the groove-like recessed part and is connected to the first plate. According to this aspect, when the first plate is pressed against the first side wall of the convex part through the flexible member, it is possible to prevent the first plate from warping away from the first side wall.

In the disclosure, the flexible member is provided so that it overlaps a second side wall that is adjacent to the first side wall in the one convex part and a third side wall that is adjacent to a side opposite to the second side wall in the first side wall in the one convex part. According to this aspect, since the periphery of the temperature sensor is covered with the flexible member, cold air does not easily directly reach the temperature sensor. Accordingly, the temperature sensor can appropriately monitor a temperature of water filled into the recessed parts for water storage and the like.

In the disclosure, the cover member includes an end plate that overlaps the bottom wall through the flexible member and a first plate that overlaps the first side wall through the flexible member. According to this aspect, the first plate appropriately presses the temperature sensor against the ice making tray through the flexible member.

In the disclosure, the cover member includes a second plate that overlaps the second side wall through the flexible member and a third plate that overlaps the third side wall through the flexible member. According to this aspect, since a gap is unlikely to occur between the flexible member and the ice making tray in the periphery of the temperature sensor, cold air does not easily directly reach the temperature sensor. Accordingly, the temperature sensor can appropriately monitor a temperature of water filled into the recessed parts for water storage and the like.

In the disclosure, at least a part of the flexible member projects from between the second plate and the ice making tray and between the third plate and the ice making tray. According to this aspect, since a gap is unlikely to occur between the flexible member and the ice making tray in the periphery of the temperature sensor, cold air does not easily directly reach the temperature sensor. Accordingly, the temperature sensor can appropriately monitor a temperature of water filled into the recessed parts for water storage and the like.

In the disclosure, in the temperature sensor, the sealing coating layer covering the temperature detection chip is not covered with the exterior case and is exposed. That is, in the temperature sensor, the sealing coating layer is provided to cover the temperature detection chip, but the exterior case is not used. Accordingly, it is possible to reduce the cost of the temperature sensor and reduce the size of the temperature sensor. In addition, when the size of the temperature sensor is reduced, it is possible to alleviate restriction of a position at which the temperature sensor is provided in the ice making tray and the like. In addition, since the temperature sensor is covered with a flexible member, cold air does not easily directly reach the temperature sensor. Accordingly, the temperature sensor can appropriately monitor a temperature of water filled into the recessed parts for water storage and the like. In addition, when the size of the temperature sensor is reduced, the temperature sensor is appropriately easily covered with the flexible member.

Embodiments of the disclosure will be described with reference to the drawings. In the following description, three directions that cross each other will be described as a first direction X (length direction), a second direction Y (width direction), and a third direction Z (vertical direction). In addition, in the description, X1 refers to one side in the first direction X, X2 refers to the other side in the first direction X, Y1 refers to one side in the second direction Y, Y2 refers to the other side in the second direction Y, Z1 refers to one side (upper side) in the third direction Z (vertical direction), and Z2 refers to the other side (lower side) in the third direction Z (vertical direction).

(Overall Configuration)

Figure 2:
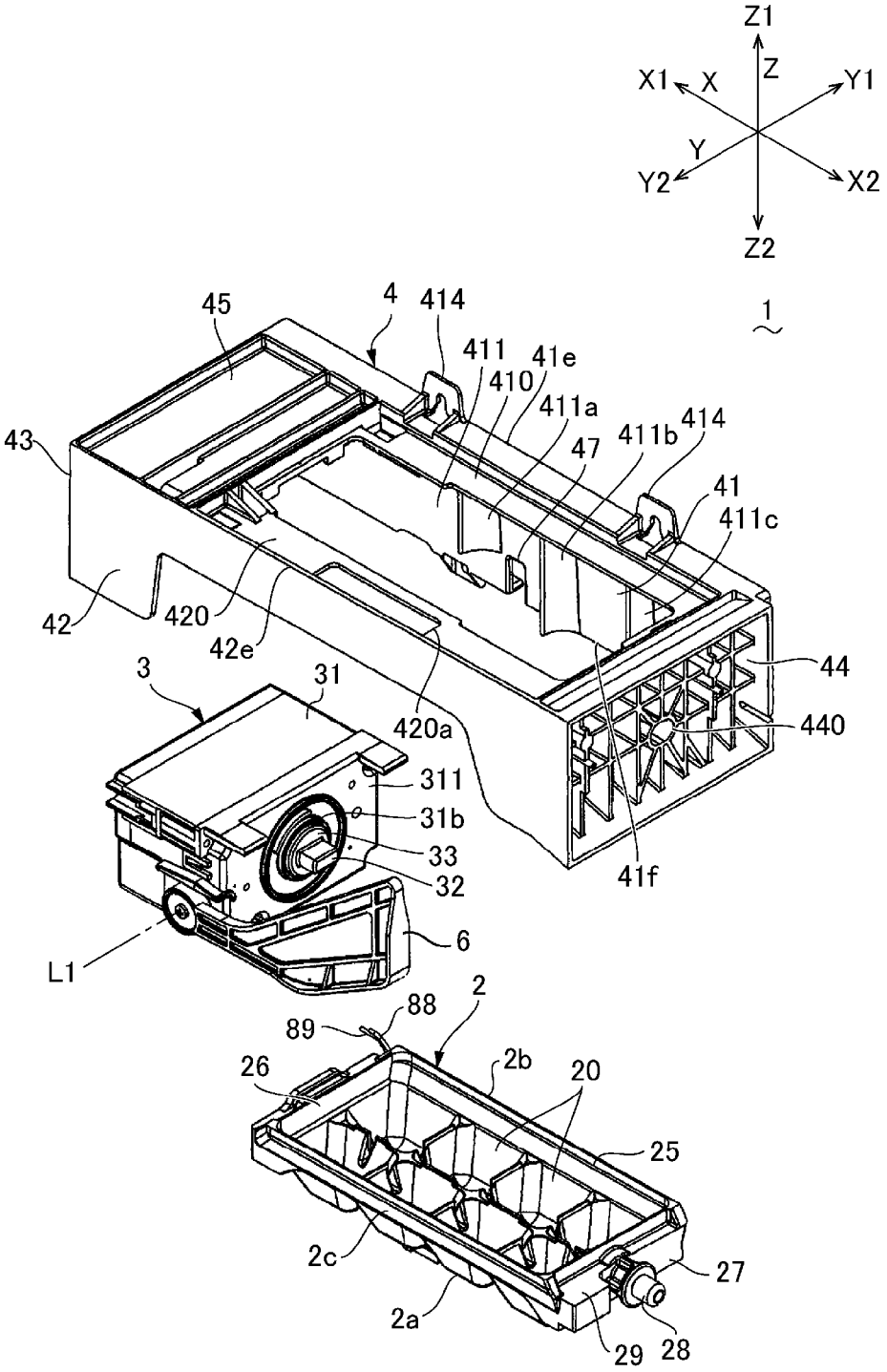
FIG. 2 is an exploded perspective view of the ice making device shown in FIG. 1 when viewed from the side on which the second side plate is disposed and viewed obliquely from above.
Figure 3:
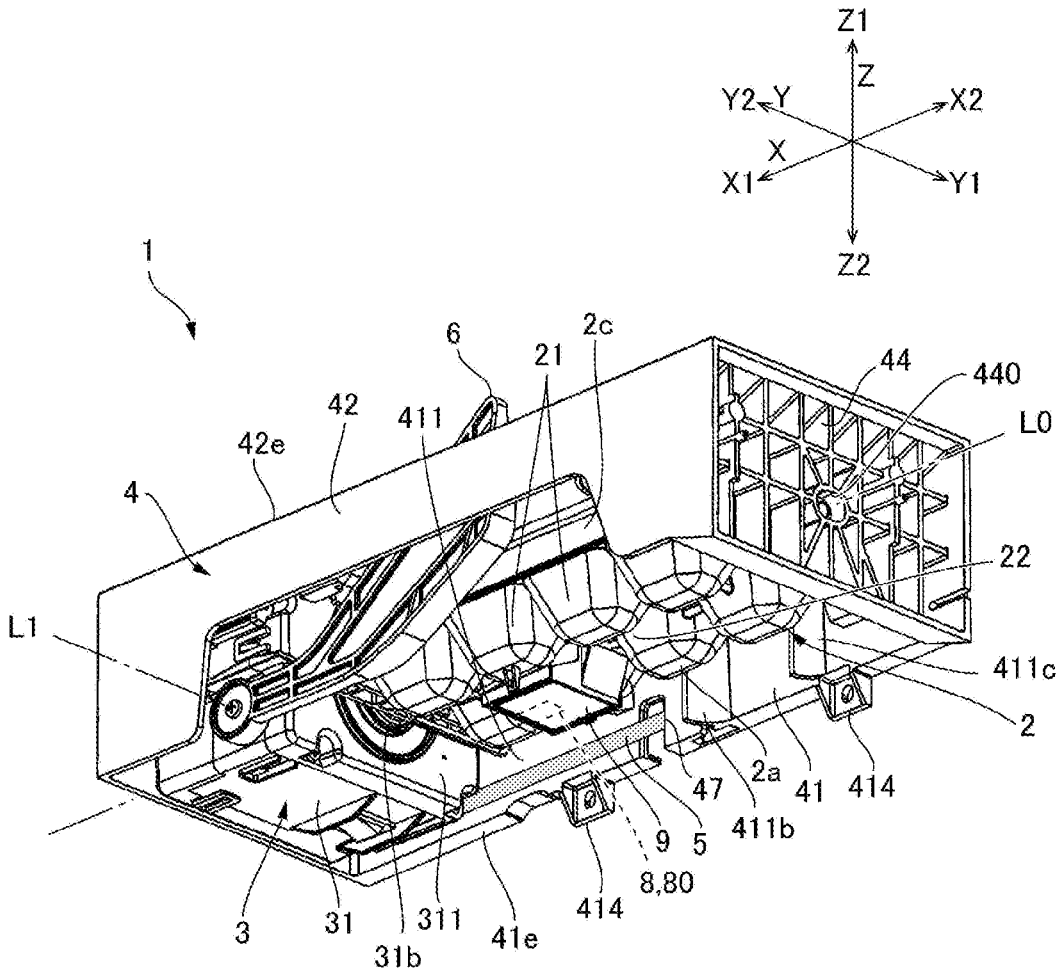
FIG. 3 is an exploded perspective view of the ice making device shown in FIG. 1 when viewed from the side on which the second side plate is disposed and viewed obliquely from below.

FIG. 1 is a perspective view of an ice making device 1 to which the disclosure is applied when viewed from the side on which a second side plate 42 is disposed and viewed obliquely from above. FIG. 2 is an exploded perspective view of the ice making device 1 shown in FIG. 1 when viewed from the side on which the second side plate 42 is disposed and viewed obliquely from above. FIG. 3 is an exploded perspective view of the ice making device 1 shown in FIG. 1 when viewed from the side on which the second side plate 42 is disposed and viewed obliquely from below.

The ice making device 1 shown in FIG. 1 to FIG. 3 includes an ice making tray 2 in which recessed parts for water storage 20 (cells) are disposed toward the one side Z1 (upper side) in the third direction Z, a drive unit 3 that is disposed on the one side X1 of the ice making tray 2 in the first direction X, and a frame 4 that supports the ice making tray 2 and the drive unit 3. The ice making device 1 is mounted on a refrigerator main body (not shown). In the refrigerator, water in a water supply tank (not shown) is filled into the recessed parts for water storage 20 of the ice making tray 2 through a water supply pipe (not shown) and ice making is performed. Then, when the ice making is completed, the drive unit 3 causes the ice making tray 2 to perform an inversion operation around an axis L0 that extends in the first direction X and a twist operation as an ice removal operation and thereby causes ice in the ice making tray 2 to fall into an ice storage container (not shown).

(Configuration of Ice Making Tray 2)

The ice making tray 2 is a member that is made of a resin material and molded to have a substantially rectangular planar shape, and is made of an elastically deformable material. In the ice making tray 2, a plurality of recessed parts for water storage 20 are arranged in the first direction X and the second direction Y. For example, in the ice making tray 2, inside a frame part 25 having a substantially rectangular shape, two recessed parts for water storage 20 arranged in the second direction Y as a set are disposed in four rows in the first direction X. In the frame part 25 of the ice making tray 2, a connecting part 24 (refer to FIG. 5) connected to an output shaft 32 of the drive unit 3 is formed on a wall part 26 that is disposed on the one side X1 in the first direction X, and a shaft part 28 that is rotatably supported on the frame 4 is formed on a wall part 27 that is disposed on the other side X2 in the first direction X. On the wall part 27 of the ice making tray 2, a rotation regulating part 29 that comes in contact with the frame 4 when the ice making tray 2 rotates around the axis L0 is formed. The rotation regulating part 29 causes the ice making tray 2 to perform a twist operation by preventing rotation of the ice making tray 2.

In the ice making tray 2, on a bottom surface 2*a* in the third direction Z, a plurality of convex parts 21 reflecting the shape of the plurality of recessed parts for water storage 20 are arranged. On the bottom surface 2*a* of the ice making tray 2, a temperature sensor 8 configured to detect a temperature of the ice making tray 2 is disposed. The temperature sensor 8 is covered with a cover member 9 fixed to the bottom surface 2*a* of the ice making tray 2. Signal wirings 88 and 89 extend from the temperature sensor 8 into the drive unit 3. In the present embodiment, the temperature sensor 8 is a thermistor 80.

(Configuration of Drive Unit 3)

As shown in FIG. 2, the drive unit 3 includes a motor (not shown) serving as a driving source, a rotation transmission mechanism (not shown) configured to transmit a rotation force of the motor, and a cam gear 33 to which a rotation force of the motor is transmitted by the rotation transmission mechanism inside a case 31 molded in a rectangular parallelepiped. A wiring for power supply (not shown) to the motor is drawn out from the drive unit 3 to the outside of the frame 4. In the cam gear 33, the output shaft 32 to which the connecting part 24 (refer to FIG. 5) of the ice making tray 2 is connected is integrally mold. The output shaft 32 protrudes from a hole 316 provided on an end plate 311 of the case 31 to the outside of the case 31. When viewed from the other side X2 in the first direction X, the output shaft 32 rotates around the axis L0 in a counterclockwise direction when ice in the ice making tray 2 is removed, and rotate in a clockwise direction when the ice making tray 2 is returned to an original position.

At a position adjacent to the ice making tray 2 on the other side Y2 in the second direction Y, an ice detection lever 6 is disposed. In the case 31 of the drive unit 3, an ice detection mechanism causing the ice detection lever 6 to rotate around the axis L1 and operate in connection with the cam gear 33 according to a rotation angle of the cam gear 33, a switch mechanism that operates based on a signal input from the temperature sensor 8 through the signal wirings 88 and 89, and the like are provided.

(Configuration of Frame 4)

The frame 4 includes a first side plate 41 that extends in the first direction X along a first side surface 2*b* of the ice making tray 2 on one side Y1 in the second direction Y, and the second side plate 42 that extends in the first direction X along a second side surface 2*c* of the ice making tray 2 on the other side Y2 in the second direction Y. The first side plate 41 and the second side plate 42 face each other in parallel in the second direction Y. The ice detection lever 6 is disposed between the second side plate 42 and the ice making tray 2.

From an upper end 41*e* (edge on the one side Z1 in the third direction Z) of the first side plate 41, a first upper plate part 410 projects toward the second side plate 42. The first upper plate part 410 is bent downward at an intermediate position toward the other side Y2 in the second direction Y and then projects toward the second side plate 42. From the vicinity of an upper end 42*e* (edge on the one side Z1 in the third direction Z) of the second side plate 42, a second upper plate part 420 projects toward the first side plate 41. The ice making tray 2 faces upward in an open state (the one side Z1 in the third direction Z) between the first upper plate part 410 and the second upper plate part 420. An opening 420*a* is formed in the second upper plate part 420. The upper end part of the ice detection lever 6 is disposed inside the opening 420*a*.

Ends of the first side plate 41 and the second side plate 42 on the one side X1 in the first direction X overlap the drive unit 3 when viewed in the second direction Y. The first side plate 41 and the second side plate 42 are connected by a plate-like first wall part 43 that is disposed at an end on the one side X1 in the first direction X and a second wall part 44 that is disposed at an end on the other side X2 in the first direction X. The first side plate 41 and the second side plate 42 are also connected by an upper plate part 45 that covers the drive unit 3 from the upper side on the one side Y1 in the second direction Y. The second wall part 44 is a porous wall in which a plurality of plate-like ribs are connected to each other, and a shaft hole 440 that rotatably supports the shaft part 28 of the ice making tray 2 is formed at the center thereof.

On a wall (an inner wall 411) on the side on which the ice making tray 2 is disposed in the first side plate 41, a plurality of reinforcing ribs 411*a*, 411*b*, and 411*c* are formed to extend in the vertical direction. In the first side plate 41, on a wall (outer wall) on the side opposite to the ice making tray 2, in the upper end 41*e* and a lower end 41*f* of the first side plate 41, on the other side X1 of the drive unit 3 in the first direction X, a plurality of attachment parts 414 that fix the frame 4 to a refrigerator main body when the ice making device 1 is mounted on the refrigerator main body (not shown) are formed. In the lower end 41*f* of the first side plate 41, a penetration part 47 constituted by a notch is formed between the attachment parts 414 adjacent to each other in the first direction X. A wiring 5 through which power is supplied to the drive unit 3 extends from the drive unit 3 to the other side X2 in the first direction X along the inner wall 411 of the first side plate 41 and is then drawn to the outside from the penetration part 47.

Accordingly, when the drive unit 3 causes the ice making tray 2 to perform a twist operation in order to perform an ice removal operation, even if a large force is applied to the frame 4 due to a reaction force, transmission of the force to the side of the penetration part 47 of the first side plate 41 is prevented by the attachment part 414 provided on the one side X1 of the penetration part 47 in the first direction X. Accordingly, in the first side plate 41, since concentration of stress in the vicinity of the penetration part 47 can be prevented, it is possible to prevent the first side plate 41 from being damaged in the vicinity of the penetration part 47.

(Operations)

In the ice making device 1 of the present embodiment, in an ice making process, water is supplied to the ice making tray 2 in which the recessed parts for water storage 20 are horizontally disposed upward through a water supply pipe (not shown), and water is filled into the recessed parts for water storage 20. Then, water filled into the ice making tray 2 is cooled by a cooling part (not shown) that is provided above the ice making tray 2. Determination of whether ice making is completed is performed according to determination of whether a temperature of the ice making tray 2 is equal to or lower than a predetermined temperature by the temperature sensor 8 (the thermistor 80) attached to the ice making tray 2.

When the ice making is completed, an amount of ice in an ice storage container (not shown) provided below the ice making tray 2 is detected by the ice detection lever 6. Specifically, the ice detection lever 6 is driven by the drive unit 3 and lowered. In this case, when the ice detection lever 6 is lowered to a predetermined position, it is determined that the ice storage container is not full of ice. On the other hand, when the ice detection lever 6 comes in contact with ice in the ice storage container before the ice detection lever 6 is lowered to a predetermined position, it is determined that the ice storage container is full of ice. When the ice storage container is full of ice, a predetermined time is waited and then again an amount of ice in the ice storage container is detected by the ice detection lever 6.

When the ice storage container is not full of ice, an ice removal operation of the ice making tray 2 is performed. Specifically, when the output shaft 32 of the drive unit 3 is driven to rotate, the ice making tray 2 rotates around the axis L0. When the ice making tray 2 rotates to a predetermined rotation angle (for example, 120°) of 90° or more from the first position horizontally disposed, the rotation regulating part 29 of the ice making tray 2 comes in contact with the frame 4. In this state, even if the ice making tray 2 tries to further rotate, rotation is prevented, and the ice making tray 2 is twisted and deformed. Accordingly, ice in the ice making tray 2 is removed from the ice making tray 2, and falls into the ice storage container (not shown) provided below the ice making tray 2.

Thereafter, the drive unit 3 reversely rotates the ice making tray 2 so that the recessed parts for water storage 20 face upward, and the above operation is repeated.

(Configuration of Temperature Sensor 8)

Figure 4:
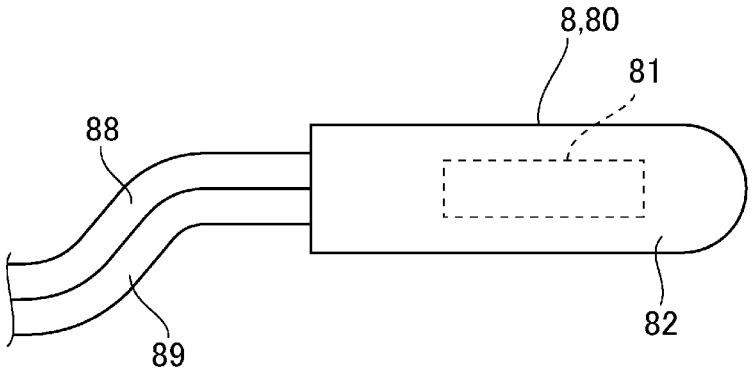
FIG. 4 is an explanatory diagram of a temperature sensor used in the ice making device 1 shown in FIG. 1.

FIG. 4 is an explanatory diagram of the temperature sensor 8 used in the ice making device 1 shown in FIG. 1. As shown in FIG. 4, in the temperature sensor 8 (the thermistor 80), a sealing coating layer 82 covering a temperature detection chip 81 (thermistor element chip) is not covered with an exterior case but is exposed. That is, in the temperature sensor 8, the sealing coating layer 82 made of a coating material such as glass or a resin is provided to cover the chip 81, but the exterior case is not used. In the present embodiment, in the temperature sensor 8, the chip 81 is coated with glass (sealing coating layer) and then coated with an epoxy resin (sealing coating layer). The temperature sensor 8 (the thermistor 80) has a round bar shape that extends on the axis L2.

(Structure of Fixing Temperature Sensor 8 to Ice Making Tray 2)

Figure 5:
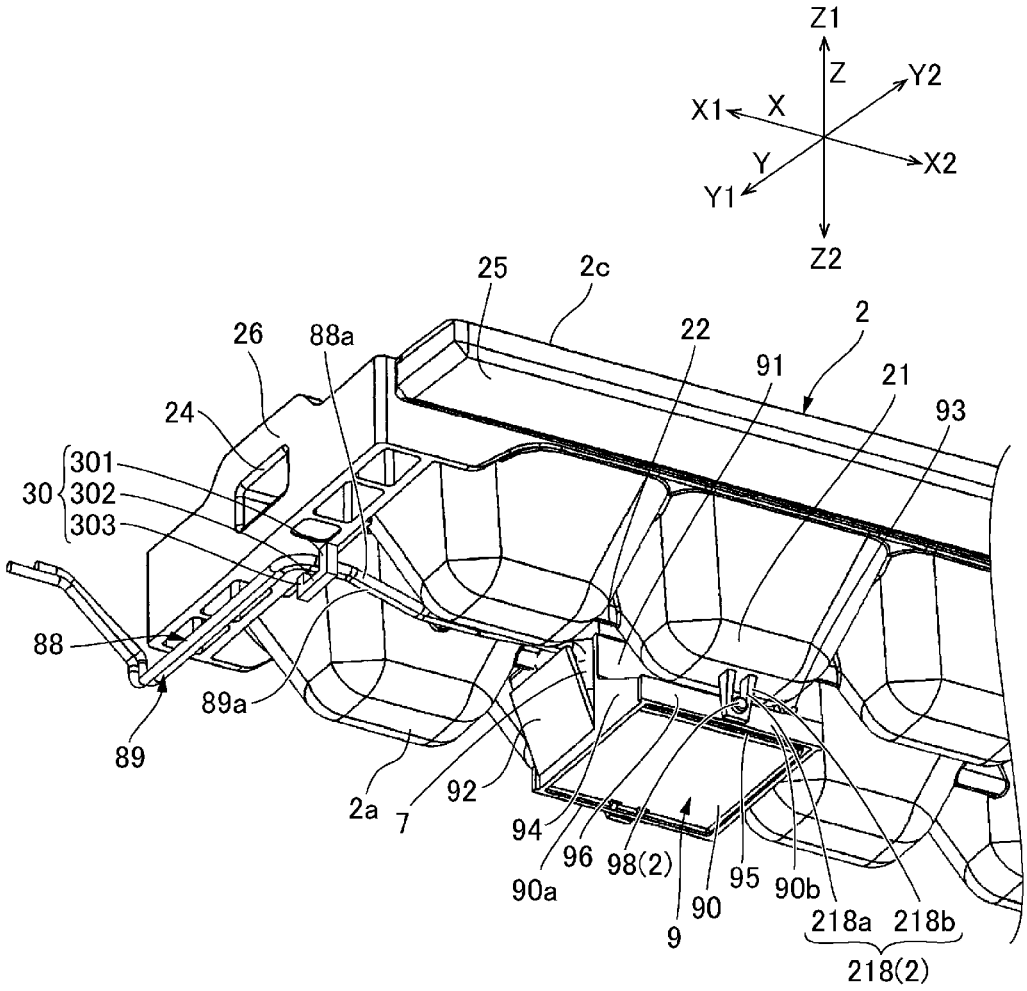
FIG. 5 is a perspective view of an aspect in which a cover member is fixed to a bottom surface of an ice making tray shown in FIG. 2 when viewed from below.
Figure 6:
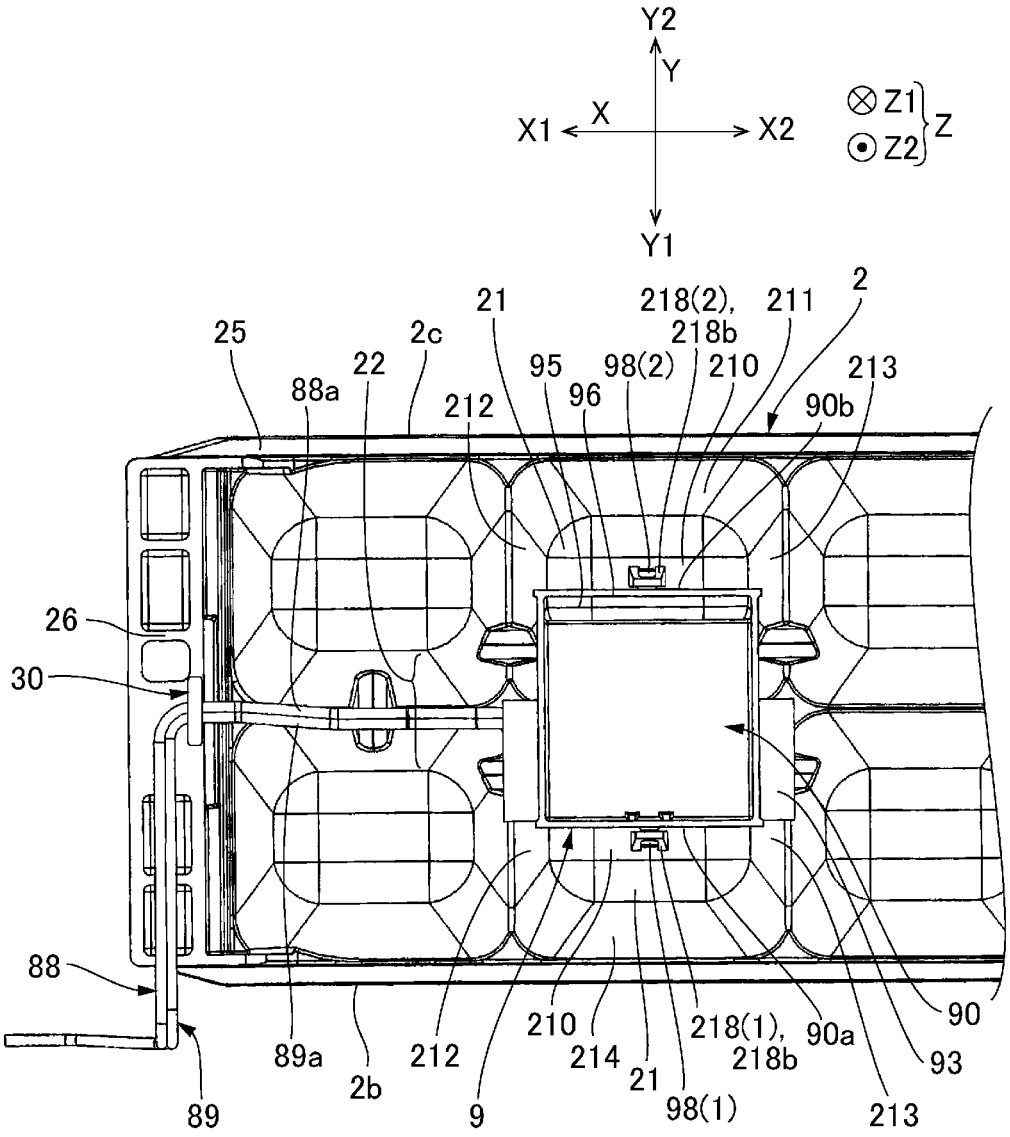
FIG. 6 is a bottom view of a state shown in FIG. 5 when viewed from below.
Figure 7:
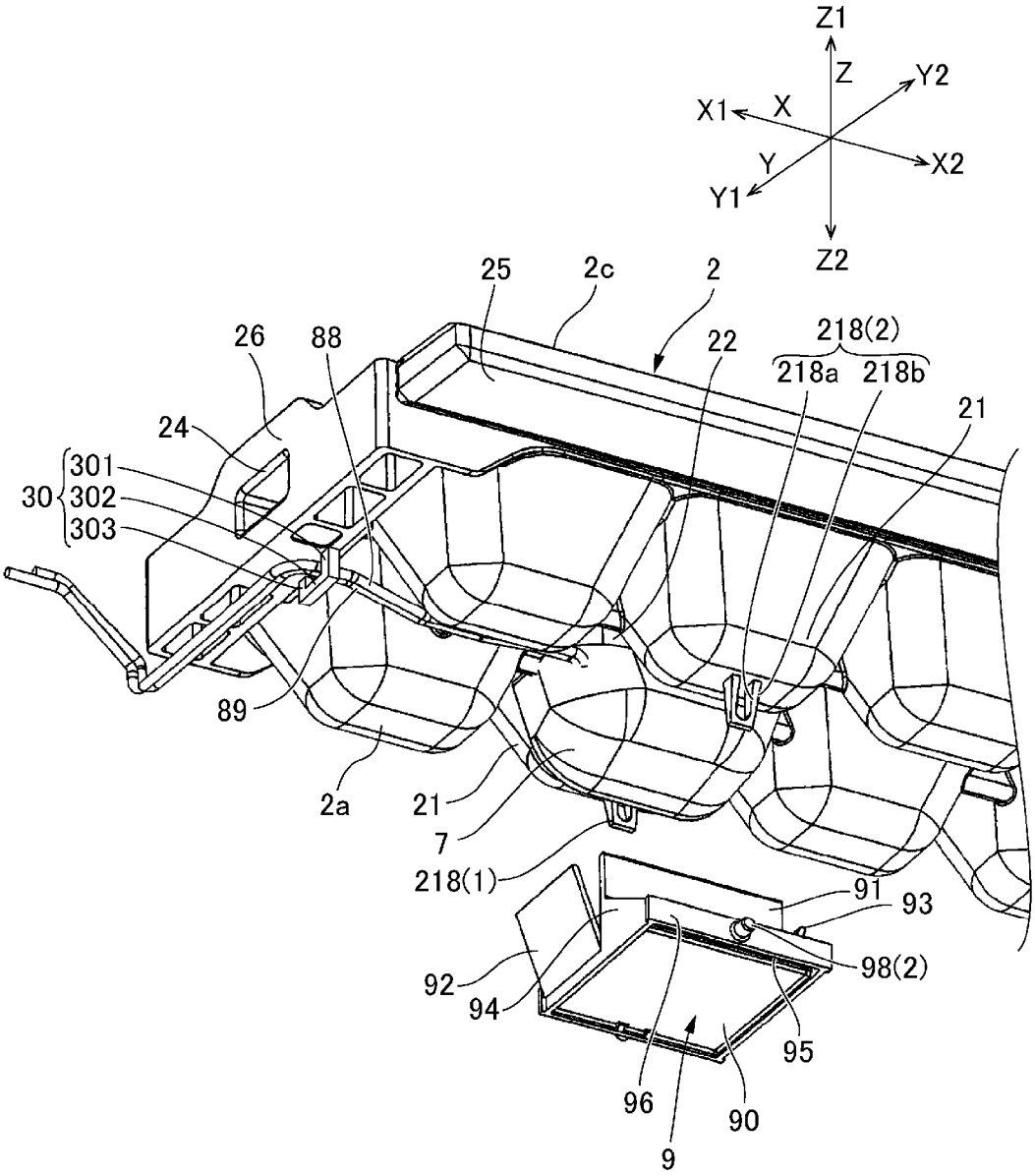
FIG. 7 is a perspective view of an aspect in which the cover member is removed from the state shown in FIG. 5 when viewed from below.
Figure 8:
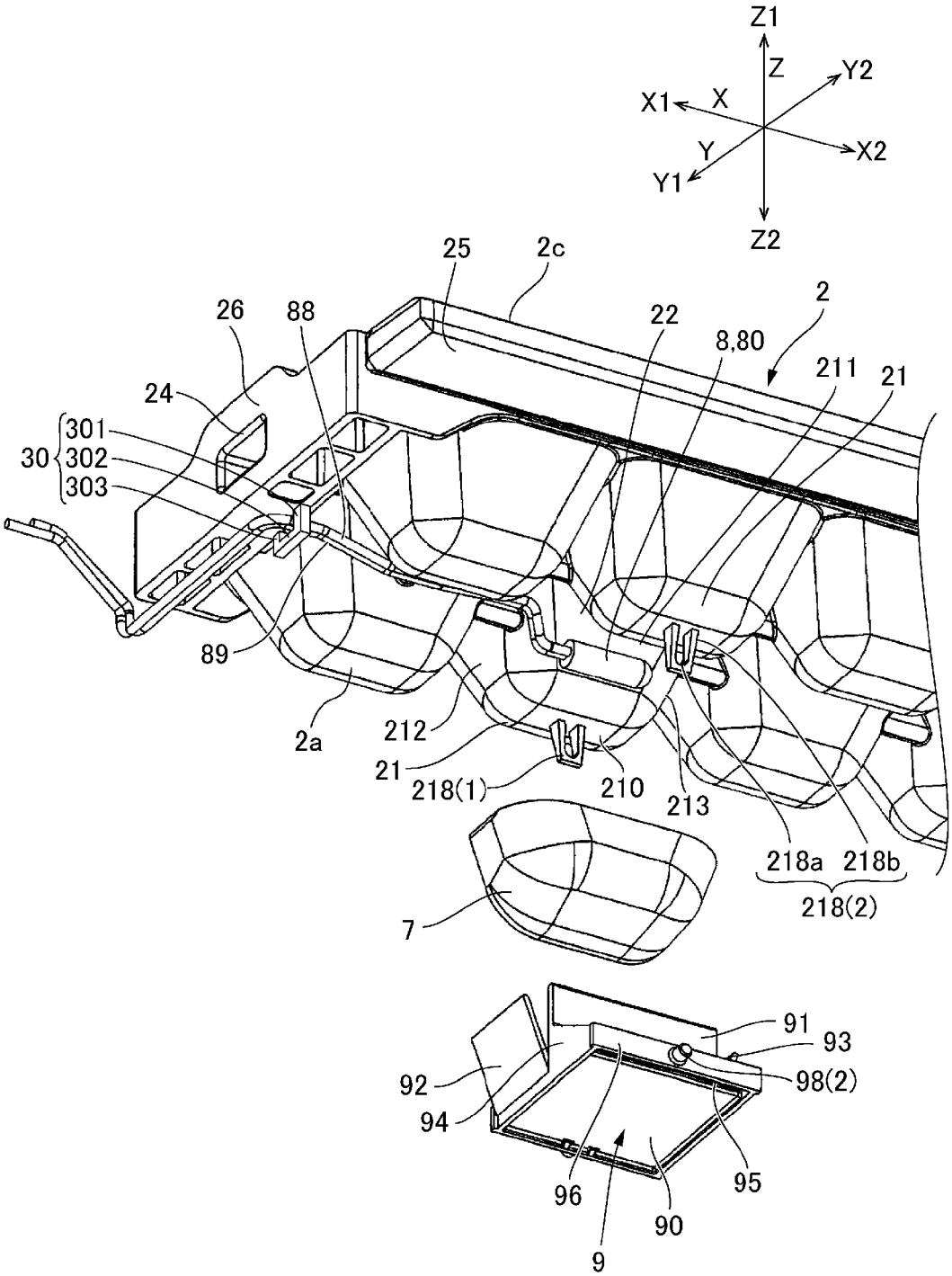
FIG. 8 is a perspective view of an aspect in which a flexible member is removed from the state shown in FIG. 7 when viewed from below.
Figure 9:
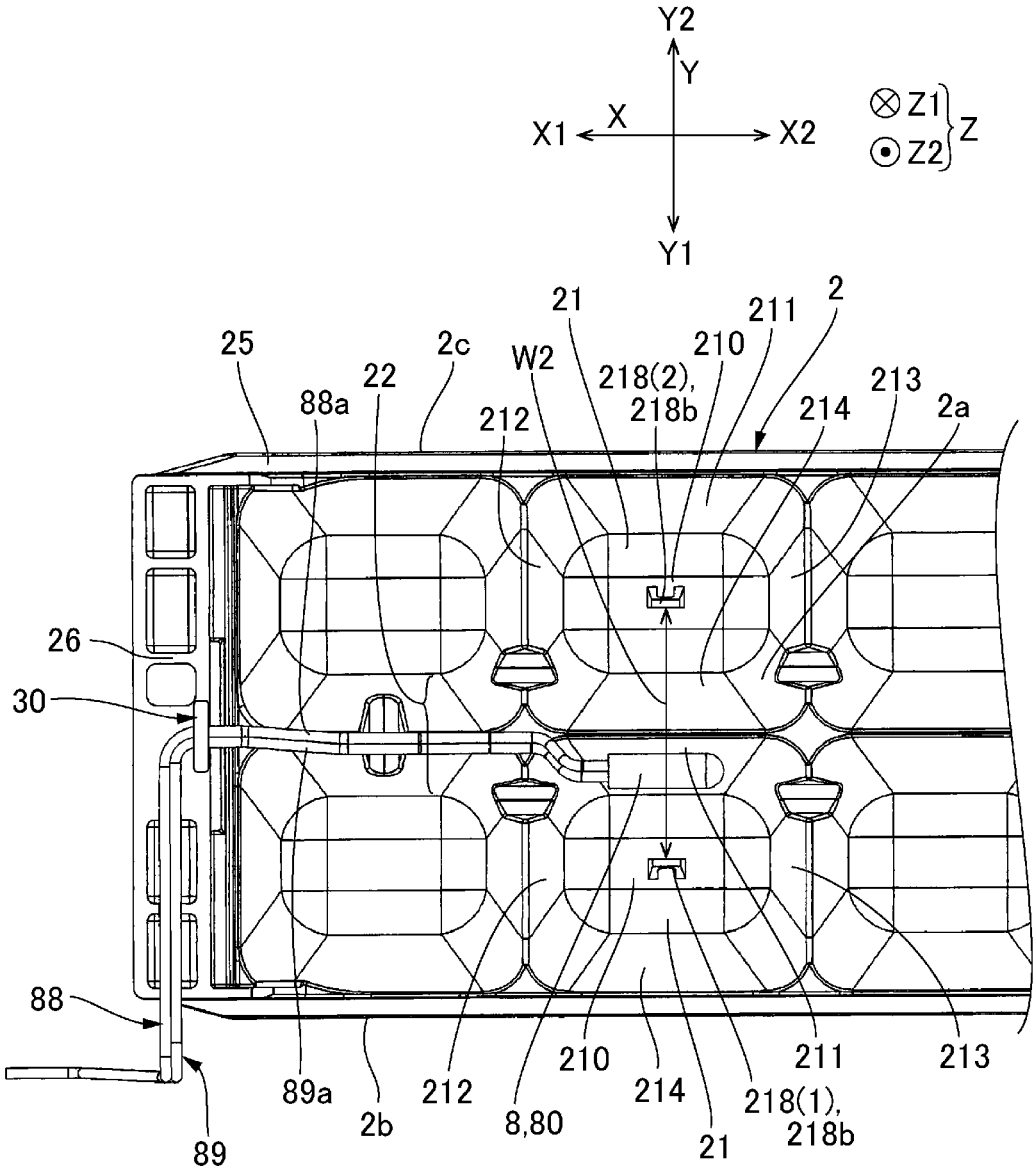
FIG. 9 is a bottom view of a state shown in FIG. 8 when viewed from below.
Figure 10:
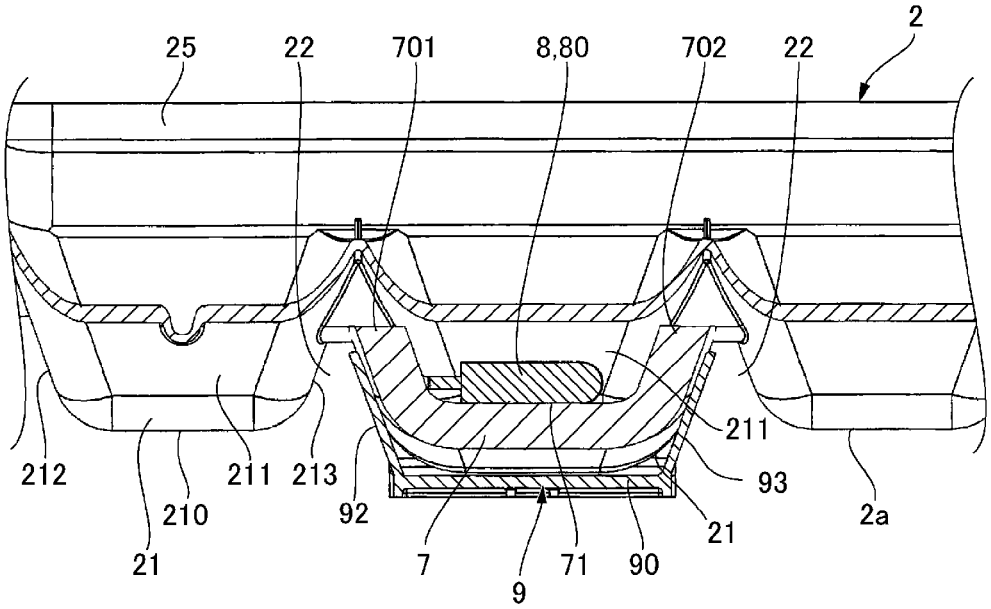
FIG. 10 is a cross-sectional view when the ice making tray is cut in a first direction X at a position at which a temperature sensor passes.
Figure 11:
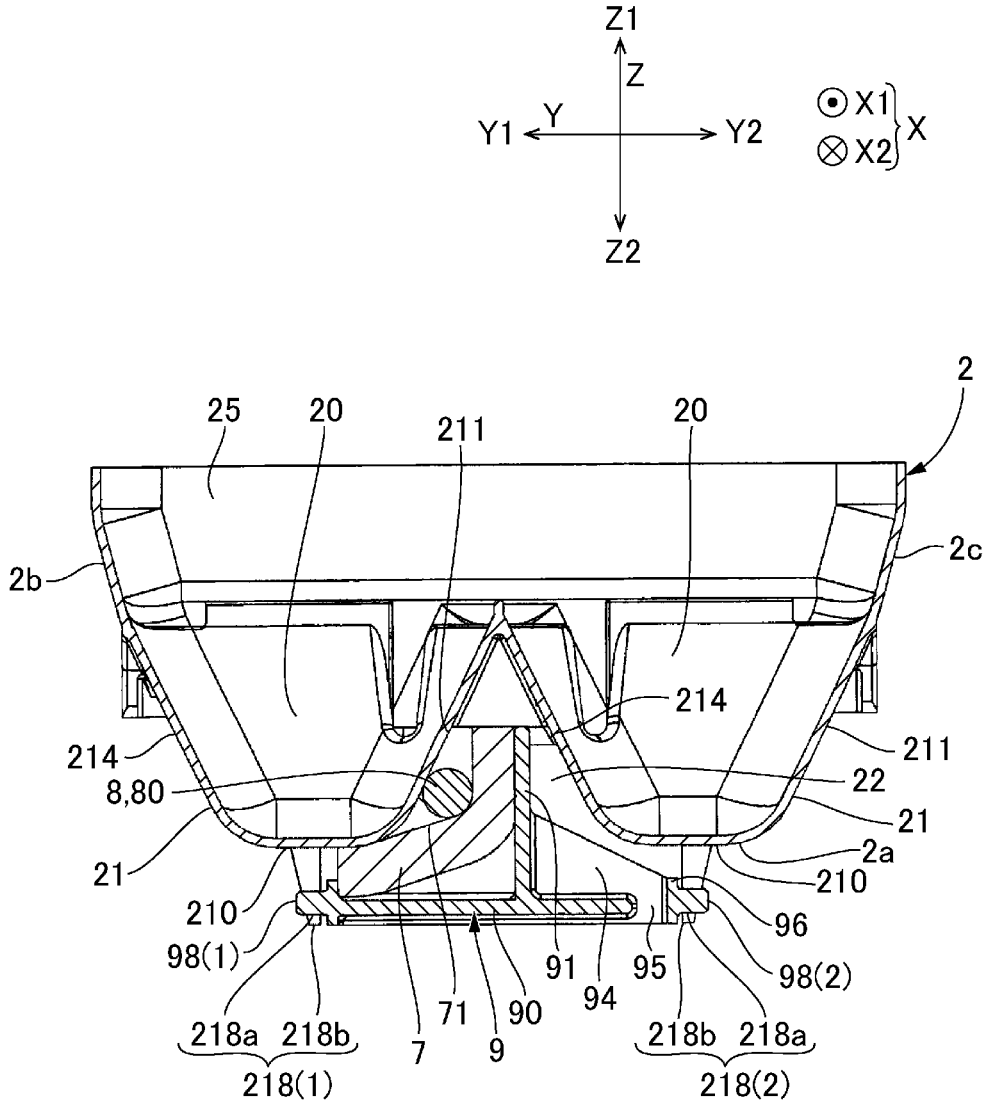
FIG. 11 is a cross-sectional view when the ice making tray is cut in a second direction Y at a position at which a temperature sensor passes.
Figure 12A:
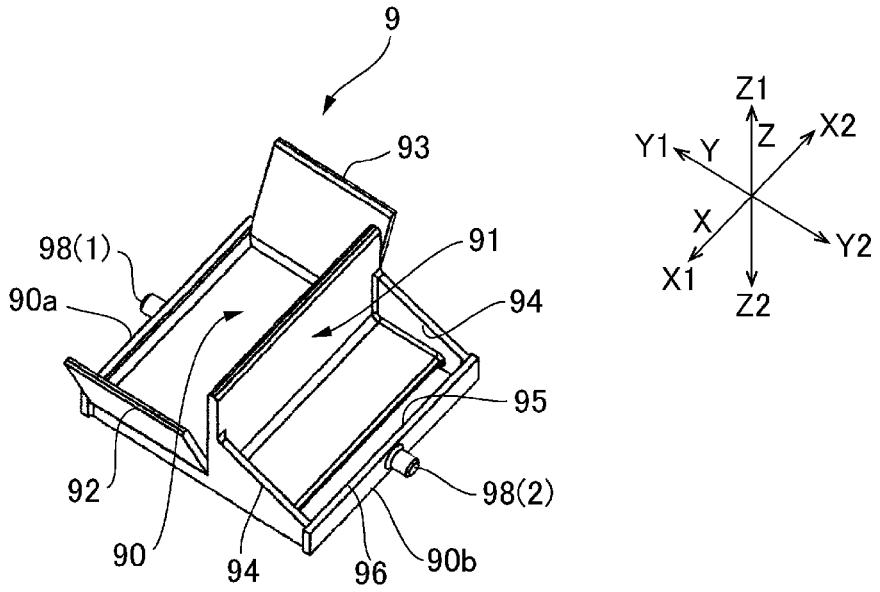
FIGS. 12(*a*) and 12(*b*) are perspective view and plan view of a cover member respectively.
Figure 12B:
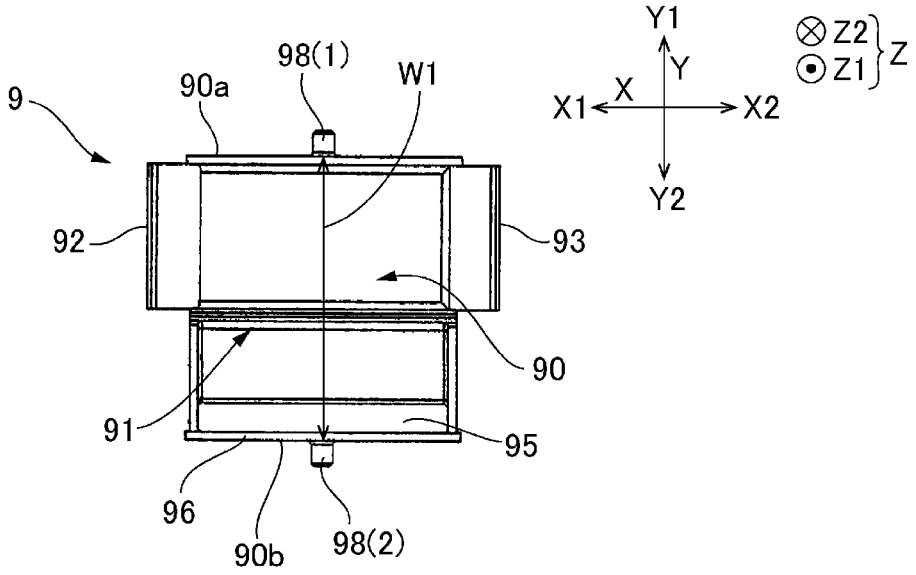

FIG. 5 is a perspective view of an aspect in which the cover member 9 is fixed to the bottom surface 2*a* of the ice making tray 2 shown in FIG. 2 when viewed from below. FIG. 6 is a bottom view of a state shown in FIG. 5 when viewed from below. FIG. 7 is a perspective view of an aspect in which the cover member 9 is removed from the state shown in FIG. 5 when viewed from below. FIG. 8 is a perspective view of an aspect in which a flexible member 7 is removed from the state shown in FIG. 7 when viewed from below. FIG. 9 is a bottom view of the state shown in FIG. 8 when viewed from below. FIG. 10 is a cross-sectional view when the ice making tray 2 is cut in the first direction X at a position at which the temperature sensor 8 passes. FIG. 11 is a cross-sectional view when the ice making tray 2 is cut in the second direction Y at a position at which the temperature sensor 8 passes. FIG. 12(*a*) is a perspective view of the cover member 9 and FIG. 12(*b*) is a plan view of the cover member 9.

As shown in FIG. 5 to FIG. 1, on the bottom surface 2*a* of the ice making tray 2, the plurality of convex parts 21 reflecting the shape of the plurality of recessed parts for water storage 20 disposed in the first direction X and the second direction Y (width direction) are formed, and a groove-like recessed part 22 is formed between the plurality of convex parts 21.

In the present embodiment, as will be described below, inside the groove-like recessed part 22, the temperature sensor 8 is disposed to come in contact with a first side wall 211 that faces in a direction crossing a vertical direction in one convex part 21 among the plurality of convex parts 21. More specifically, the plurality of convex parts 21 each have a bottom wall 210 and four side walls connected to the bottom wall 210 via a fillet (a part with rounded corners). The four side walls include a first side wall 211 that faces the other side Y2 in the second direction Y, a second side wall 212 that faces the one side X1 in the first direction X and is connected to the first side wall 211 via a fillet, a third side wall 213 that faces the other side X2 in the first direction X and is connected to the first side wall 211 via a fillet, and a fourth side wall 214 that faces the one side Y1 in the second direction Y on the side opposite to the first side wall 211. The fourth side wall 214 is connected to the second side wall 212 and the third side wall 213 via a fillet. The temperature sensor 8 is in contact in an orientation in which the axis L2 is in the first direction X with respect to the first side wall 211 of the convex part 21 disposed on the one side Y1 in the second direction Y in the second position from the drive unit 3. In this state, the temperature sensor 8 is always in contact with the convex part 21 without overlapping the fillet between the first side wall 211 and the second side wall 212 and the fillet between the first side wall 211 and the third side wall 213.

The temperature sensor 8 is in contact with a position away from the bottom wall 210 and the base within the first side wall 211. More specifically, the temperature sensor 8 is in contact with a position closer to the bottom wall 210 than an intermediate position in the height direction within the first side wall 211. Accordingly, the temperature sensor 8 is in contact with the first side wall 211 below a liquid level of water or the like filled into the recessed parts for water storage 20.

As shown in FIG. 7, FIG. 8, and FIG. 9, in the ice making tray 2, on the bottom wall 210 of the convex part 21 on which the temperature sensor 8 is disposed and the bottom wall 210 of the convex part 21 (adjacent convex part) adjacent to the side of the first side wall 211 of the convex part 21 on which the temperature sensor 8 is disposed, a pair of engaged parts 218 (a first engaged part 218(1) and a second engaged part 218(2)) for fixing the cover member 9 are formed. In the present embodiment, each of the first engaged part 218(1) and the second engaged part 218(2) is a frame-like convex part 218*b* that protrudes downward from the bottom wall 210 of the convex part 21 so that an engagement hole 218*a* is formed.

In addition, in the ice making tray 2, on the wall part 26 that is disposed on the one side X1 in the first direction X close to the drive unit 3, a hook 30 for locking the signal wirings 88 and 89 from the temperature sensor 8 is provided. The hook 30 is provided at the central part in the second direction Y and overlaps the groove-like recessed part 22 when viewed in the first direction X. As shown in FIG. 5, the hook 30 includes a protruding part 301 that protrudes from the wall part 26 to the other side Z2 in the third direction Z, an extension part 302 that extends from a tip of the protruding part 301 to the one side Y1 in the second direction Y along the wall part 26, and a claw part 303 that protrudes from a tip of the extension part 302 to the one side Z1 (side of the wall part 26) in the third direction Z.

The signal wirings 88 and 89 are drawn from the temperature sensor 8 with the groove-like recessed part 22 on the one side X1 in the first direction X and hooked to the hook 30. When locked to the hook 30, the signal wirings 88 and 89 extend from the one side Y1 in the second direction X and are inserted between the extension part 302 and the wall part 26 through a gap between the claw part 303 and the wall part 26. Then, the signal wirings 88 and 89 are bent on the one side Y1 in the second direction Y, drawn along the wall part 26, and connected to the drive unit 3.

Here, in the present embodiment, since the signal wirings 88 and 89 are locked to the hook 30, when the ice making tray 2 rotates, wiring parts 88*a* and 89*a* between the hook 30 and the temperature sensor 8 in the signal wirings 88 and 89 do not move away from the ice making tray 2. Accordingly, since it is possible to prevent or reduce a load applied to a part connecting the signal wirings 88 and 89 and the temperature sensor 8, it is possible to prevent or reduce the occurrence of disconnection in the signal wirings 88 and 89.

Here, when the ice making tray 2 rotates in a direction in which ice is released, since the hook 30 approaches a drawn part of the signal wirings 88 and 89 of the drive unit 3, slack occurs between the hook 30 and the drive unit 3 in the signal wirings 88 and 89. However, since the hook 30 includes the protruding part 301 that can come in contact with the signal wirings 88 and 89 from behind the ice making tray 2 in a rotation direction, the signal wirings 88 and 89 locked to the hook 30 are prevented from escaping from the hook 30.

Next, the temperature sensor 8 is covered with the flexible member 7 on the bottom surface 2*a* of the ice making tray 2. In the present embodiment, the flexible member 7 is a heat insulating member composed of a resin porous member 70 (foamed member) molded into a sheet shape or a plate shape, and overlaps the first side wall 211 so that the temperature sensor 8 is interposed, and is deformed so that it partially overlaps the bottom wall 210, the second side wall 212, and the third side wall 213. Here, in the flexible member 7, an adhesive layer (not shown) is formed on a surface 71 on the side on which the ice making tray 2 is disposed and the surface on the side on which the ice making tray 2 is disposed has adhesiveness. Accordingly, when the temperature sensor 8 is attached to the surface 71 of the flexible member 7 using the adhesiveness and then the flexible member 7 is pressed against the ice making tray 2 together with the temperature sensor 8, a state shown in FIG. 7, FIG. 10 and FIG. 11 is obtained.

In the present embodiment, the cover member 9 is fixed to the bottom surface 2*a* of the ice making tray 2 so that the temperature sensor 8 is pressed against the ice making tray 2 through the flexible member 7. In the present embodiment, the cover member 9 is made of a resin, and a first plate 91, a second plate 92 and a third plate 93 to be described below are elastically deformable in the plate thickness direction.

As shown in FIG. 6 and FIGS. 12(*a*), 12(*b*), the cover member 9 has an end plate 90 that overlaps the bottom wall 210 of the convex part 21 of the ice making tray 2 through the flexible member 7. On each of both end surfaces 90*a* and 90*b* of the end plate 90 in the second direction Y, engagement shafts 98 having a round bar shape (a first engagement shaft 98(1) and a second engagement shaft 98(2): a first engagement part and a second engagement part) are formed. The engagement shafts 98(1) and 98(2) protrude in the second direction Y along the end plate 90 from the central part in the first direction X on the end surfaces 90*a* and 90*b* of the end plate 90. Here, a length W1 of the end plate 90 in the second direction Y, that is, a length W1 (refer to FIG. 12(*b*)) from the end surface 90*a* on the one side Y1 of the end plate 90 to the end surface 90*b* on the other side Y2, is the same as or slightly longer than an interval W2 (refer to FIG. 9) between the pair of engaged parts 218 (the first engaged part 218(1) and the second engaged part 218(2)) in the second direction Y. In other words, the interval W2 between the pair of engaged parts 218 is smaller than or equal to the length W1 of the end plate 90 in the second direction Y. In the present embodiment, the interval W2 between the first engaged part 218(1) and the second engaged part 218(2) is narrower than the length W1 of the end plate 90 in the second direction Y.

In addition, as shown in FIG. 5, the cover member 9 includes the end plate 90 that overlaps the bottom wall 210 through the flexible member 7, and the first plate 91 that protrudes from an intermediate position in the second direction Y in the end plate 90 into the groove-like recessed part 22 and overlaps the first side wall 211 through the flexible member 7. The first plate 91 presses the temperature sensor 8 against the first side wall 211 of the ice making tray 2 through the flexible member 7. In addition, the cover member 9 includes the second plate 92 that elastically overlaps the second side wall 212 of the convex part 21 of the ice making tray 2 through the flexible member 7 and the third plate 93 that elastically overlaps the third side wall 213 of the convex part 21 of the ice making tray 2 through the flexible member 7. The flexible member 7 is pressed against the cover member 9 and is compressed and covered with the cover member 9. Accordingly, the flexible member 7 is brought into close contact the convex part 21 of the ice making tray 2 around the temperature sensor 8. In addition, the cover member 9 includes a pair of reinforcing plates 94 that protrude from an end plate part of the other side Y2 in the second direction Y relative to the first plate 91 in the end plate 90 into the groove-like recessed part 22 and are connected to the first plate 91. Each of the pair of reinforcing plates 94 extends in the Z1 direction from both edges of the end plate 90 in the first direction X, and an end on the one side Y1 in the second direction Y is connected to the first plate 91.

Here, as shown in FIG. 12(*a*), a gap 95 that extends in the first direction X is provided at an end plate part on the other side Y2 in the second direction Y relative to the first plate 91 of the end plate 90. Accordingly, an end 96 on the other side Y2 in the second direction Y relative to the gap 95 of the end plate 90 is elastically deformable in the second direction Y. When viewed in the first direction X, the second engagement shaft 98(2) and the gap 95 overlap each other. The gap 95 extends in the X direction with a constant width between the pair of reinforcing plates 94. Accordingly, the end 96 of the end plate 90 extends in the X direction with a constant width. An end of the gap 95 in the first direction X1 reaches the reinforcing plate 94 in the first direction X1 and an end in the second direction X2 reaches the reinforcing plate 94 in the second direction X2.

When the cover member 9 is fixed to the ice making tray 2, the first engagement shaft 98(1) of the cover member 9 is inserted into the engagement hole 218*a* of the first engaged part 218(1). Then, the second engagement shaft 98(2) of the cover member 9 is inserted into the engagement hole 218*a* of the second engaged part 218(2). Accordingly, as shown in FIG. 5, the end plate 90 is pressed against the bottom wall 210 of the convex part 21 of the ice making tray 2 through the flexible member 7. Here, the end 96 of the end plate 90 on the other side Y2 in the second direction Y is elastically deformable in the second direction Y. Accordingly, when the second engagement shaft 98(2) is inserted into the engagement hole 218*a* of the second engaged part 218(2), the end 96 of the end plate 90 on the other side Y2 in the second direction Y is bent to the one side Y1 in the second direction Y. Therefore, since the second engagement shaft 98(2) is easily inserted into the engagement hole 218*a*, the cover member 9 is easily fixed to the ice making tray 2.

When the engagement shafts 98 are inserted into the engaged parts 218, the end surface 90*a* of the end plate 90 comes in contact with the first engaged part 218(1), and the end surface 90*b* comes in contact with the second engaged part 218(2). In addition, the end 96 of the end plate 90 on the other side Y2 in the second direction Y is elastically deformed. Therefore, an elastic restoring force of the end 96 of the end plate 90 acts as a force with which the first plate 91 is pressed against the first side wall 211 of the convex part 21. Accordingly, the temperature sensor 8 can be brought into contact with the ice making tray 2 more reliably.

Here, while the cover member 9 is fixed to the ice making tray 2, as shown in FIG. 10, at least parts 701 and 702 of the flexible member 7 project from between the second plate 92 of the cover member 9 and the ice making tray 2 and between the third plate 93 and the ice making tray 2.

Main Effects of Present Embodiment

As described above, in the ice making device 1 of the present embodiment, in the temperature sensor 8 (the thermistor 80), the sealing coating layer 82 covering the temperature detection chip 81 is not covered with an exterior case but is exposed. That is, in the temperature sensor 8, the sealing coating layer 82 is provided to cover the temperature detection chip 81, but the exterior case is not used. Accordingly, it is possible to reduce costs of the temperature sensor 8 and reduce the size of the temperature sensor 8. In addition, when the size of the temperature sensor 8 is reduced, it is possible to alleviate a restriction regarding, for example, a position on the ice making tray 2 at which the temperature sensor 8 is provided. In addition, since the temperature sensor 8 is covered with the flexible member 7, cold air does not easily directly reach the temperature sensor 8. In addition, the flexible member 7 is a sheet-like or plate-like porous member and has high heat insulating properties. Accordingly, the temperature sensor 8 is unlikely to receive an influence of a temperature inside an ice making room. Therefore, the temperature sensor 8 can appropriately monitor a temperature of water filled into the recessed parts for water storage 20 of the ice making tray 2 and the like. In addition, when the size of the temperature sensor 8 is reduced, the temperature sensor 8 is appropriately easily covered with the flexible member 7.

In addition, since the surface 71 of the flexible member 7 on the side of the ice making tray 2 has adhesiveness, the temperature sensor 8 can be fixed to the ice making tray 2 by the flexible member 7.

In addition, since the cover member 9 fixed to the bottom surface 2*a* of the ice making tray 2 so that the temperature sensor 8 is pressed against the ice making tray 2 through the flexible member 7 is included, the temperature sensor 8 in contact with the ice making tray 2 can be maintained. In addition, since the flexible member 7 and the temperature sensor 8 is fixed to the ice making tray 2 by the cover member 9, it is possible to prevent the flexible member 7 and the temperature sensor 8 from falling off of the ice making tray 2.

In addition, the temperature sensor 8 is in contact with the convex part 21 inside the groove-like recessed part 22 of the ice making tray 2. In this case also, since the size of the temperature sensor 8 is small, even if the width of the groove-like recessed part 22 is not widened, the temperature sensor 8 can be disposed at an appropriate position. In addition, even if the temperature sensor 8, the flexible member 7, and the cover member 9 are provided on the side of the bottom surface 2*a* of the ice making tray 2, since the temperature sensor 8 having a small size is disposed in the groove-like recessed part 22, the cover member 9 can be prevented from protruding largely from the side of the bottom surface 2*a* of the ice making tray 2.

In addition, the temperature sensor 8 is in contact with the first side wall 211 that faces in the second direction Y among side walls of the convex part 21 of the ice making tray 2. Therefore, the ice making tray 2 is twisted, since a large force is not applied to the temperature sensor 8, it is possible to prevent the temperature sensor 8 from falling off of the ice making tray 2.

In addition, since the flexible member 7 overlaps the bottom wall 210, the first side wall 211, the second side wall 212, and the third side wall 213 of the convex part 21, the periphery of the temperature sensor 8 is covered with the flexible member 7. Therefore, cold air does not easily directly reach the temperature sensor 8 and the temperature sensor 8 is unlikely to receive an influence of a temperature in the ice making room. Accordingly, the temperature sensor 8 can appropriately monitor a temperature of water filled into the recessed parts for water storage 20 of the ice making tray 2 and the like.

In addition, since the cover member 9 includes the first plate 91 that overlaps the first side wall 211 through the flexible member 7, the first plate 91 appropriately presses the temperature sensor 8 against the ice making tray 2 through the flexible member 7. Accordingly, the temperature sensor 8 can appropriately monitor a temperature of water filled into the recessed parts for water storage 20 of the ice making tray 2 and the like.

In addition, since the cover member 9 includes the second plate 92 and the third plate 93 that overlap the second side wall 212 and the third side wall 213 of the convex part 21 through the flexible member 7, a gap is unlikely to occur between the flexible member 7 and the ice making tray 2 in the periphery of the temperature sensor 8. However, since parts 701 and 702 of the flexible member 7 project from between the second plate 92 and the ice making tray 2, and between the third plate 93 and the ice making tray 2, a gap is unlikely to occur between the flexible member 7 and the ice making tray 2. Therefore, cold air does not easily directly reach the temperature sensor 8 and the temperature sensor 8 is unlikely to receive an influence of a temperature in the ice making room. Accordingly, the temperature sensor 8 can appropriately monitor a temperature of water filled into the recessed parts for water storage 20 of the ice making tray 2 and the like.

In addition, in the present embodiment, when the first engagement shaft 98(1) of the cover member 9 is inserted into the engagement hole 218*a* of the first engaged part 218(1) and the second engagement shaft 98(2) of the cover member 9 is inserted into the engagement hole 218*a* of the second engaged part 218(2), the cover member 9 can be fixed to the ice making tray 2. In addition, since the end 96 of the end plate 90 on which the second engagement shaft 98(2) is provided on the other side Y2 in the second direction Y is elastically deformable in the second direction Y, the second engagement shaft 98(2) is easily inserted into the engagement hole 218*a*. Therefore, the cover member 9 is easily fixed to the ice making tray 2.

In addition, while the first engagement shaft 98(1) is inserted into the engagement hole 218*a* of the first engaged part 218(1) and the second engagement shaft 98(2) is inserted into the engagement hole 218*a* of the second engaged part 218(2), the end 96 of the end plate 90 of the cover member 9 on the other side Y2 in the second direction Y is elastically deformed. Accordingly, an elastic restoring force of the end 96 acts as a force with which the first plate 91 is pressed against the first side wall 211 of the convex part 21. Accordingly, the temperature sensor 8 can be brought into contact with the ice making tray 2 more reliably.

In addition, in the present embodiment, the cover member 9 includes the reinforcing plate 94 that protrudes from the end plate 90 and is connected to the first plate 91. Accordingly, when the first plate 91 is pressed against the first side wall 211 of the convex part 21 through the flexible member 7, it is possible to prevent the first plate 91 from warping away from the first side wall 211.

Other Embodiments

While the thermistor 80 is used as the temperature sensor 8 in the above embodiment, the disclosure may be applied to a case in which the temperature sensor 8 other than the thermistor 80, for example, a temperature measuring resistor using platinum as a wire material, is used. While the porous member 70 is used as the flexible member 7 in the above embodiment, a heat insulating member such as a rubber sheet may be used as the flexible member 7.

What is claimed is:

1. An ice making device comprising:

an ice making tray in which at least one recessed part for water storage is disposed upward;

a drive unit that causes the ice making tray to perform an inversion operation and a twist operation around an axis that extends in a direction crossing a vertical direction;

a frame that supports the ice making tray and the drive unit;

a temperature sensor that is disposed to be in contact with a bottom surface of the ice making tray, wherein a sealing coating layer covering a chip for temperature detection is not covered with an exterior case and is exposed;

a flexible member covering the temperature sensor; and a cover member that is fixed to the bottom surface of the ice making tray, so that the temperature sensor is pressed against the ice making tray through the flexible member, wherein, in the ice making tray, the at least one recessed part for water storage is a plurality of recessed parts for water storage and are arranged along the axis and along a width direction crossing the axis, and wherein, on the bottom surface of the ice making tray, a plurality of convex parts reflecting shape of the recessed parts for water storage are formed, and wherein the temperature sensor is disposed in one of the plurality of convex parts inside groove-like recessed parts formed between the plurality of convex parts to be in contact with a first side wall that faces a direction crossing the vertical direction, and wherein the first side wall faces the width direction, and wherein the ice making tray comprises a first engaged part that protrudes from a bottom wall of the one of the plurality of convex parts and a second engaged part that faces the first side wall in the width direction and protrudes from a bottom wall of an adjacent convex part adjacent to the one convex part, and wherein the flexible member is provided, so that the flexible member overlaps the bottom wall of the one convex part and the first side wall, and wherein the cover member comprises an end plate that overlaps the bottom wall of the one convex part through the flexible member, a first plate that protrudes from an intermediate position on the end plate in the width direction into the groove-like recessed parts and overlaps the first side wall through the flexible member, a first engagement part that is disposed at an end on one side of the end plate, which refers to a side where the first engaged part is disposed in the width direction, and a second engagement part that is disposed at an end on an other side of the end plate, which refers a side where the second engaged part is disposed in the width direction, to be locked to the second engaged part, and wherein the first engaged part and the second engaged part each have an engagement hole that penetrates in the width direction, and wherein the first engagement part is a first engagement shaft that protrudes from an end surface on the one side of the end plate along the end plate in the width direction, and wherein the second engagement part is a second engagement shaft that protrudes from an end surface on the other side of the end plate along the end plate in the width direction, and wherein an interval between the first engaged part and the second engaged part in the width direction is narrower than or equal to a length of the end plate in the width direction, and wherein, while the first engagement shaft is inserted into the engagement hole of the first engaged part and the second engagement shaft is inserted into an engagement hole of the second engaged part, an end surface on the one side of the end plate comes in contact with the first engaged part, and an end surface on the other side comes in contact with the second engaged part, and wherein, in the end plate, in an end plate pail on the other side relative to the first plate, a gap that extends in a direction along the axis is provided, and wherein the second engagement shaft and the gap overlap when viewed in the width direction, and wherein an end on the other side of the end plate relative to the gap is elastically deformable in the width direction.

2. The ice making device according to claim 1, wherein the flexible member is a sheet-like or plate-like heat insulating member.

3. The ice making device according to claim 2, wherein the sheet-like heat insulating member and the plate-like heat insulating member are porous members.

4. The ice making device according to claim 1, wherein a surface of the flexible member on a side of the ice making tray has adhesiveness.

5. The ice making device according to claim 1, wherein the temperature sensor is a thermistor, and wherein the chip is a thermistor element chip.

6. The ice making device according to claim 1, wherein the interval between the first engaged part and the second engaged part is narrower than the length of the end plate in the width direction, and wherein, while the first engagement shaft is inserted into the engagement hole of the first engaged part and the second engagement shaft is inserted into the engagement hole of the second engaged part, the end on the other side of the end plate is elastically deformed.

7. An ice making device comprising:

an ice making tray in which at least one recessed part for water storage is disposed upward;

a drive unit that causes the ice making tray to perform an inversion operation and a twist operation around an axis that extends in a direction crossing a vertical direction;

a frame that supports the ice making tray and the drive unit;

a temperature sensor that is disposed to be in contact with a bottom surface of the ice making tray, wherein a sealing coating layer covering a chip for temperature detection is not covered with an exterior case and is exposed;

a flexible member covering the temperature sensor; and a cover member that is fixed to the bottom surface of the ice making tray so that the temperature sensor is pressed against the ice making tray through the flexible member, wherein, in the ice making tray, the at least one recessed part for water storage is a plurality of recessed parts for water storage and are arranged along the axis and along a width direction crossing the axis, and wherein, on the bottom surface of the ice making tray, a plurality of convex parts reflecting shape of the recessed parts for water storage are formed, and wherein the sensor is disposed in one of the plurality of convex parts inside groove-like recessed parts formed between the plurality of convex parts to be contact with s side wall that faces a direction crossing the vertical direction, and wherein the first side wall faces the width direction, and wherein the ice making tray comprises a first engaged part that protrudes from a bottom wall of the one of the plurality of convex parts and a second engaged part that faces the first side wall in the width direction and protrudes from a bottom wall of an adjacent convex part adjacent to the one convex part, and wherein the flexible member is provided, so that the flexible member overlaps the bottom wall of the one convex part and the first side wall, and wherein the cover member comprises an end plate that overlaps the bottom wall of the one convex part through the flexible member, a first plate that protrudes from an intermediate position on the end plate in the width direction into the groove-like recessed parts and overlaps the first side wall through the flexible member, a first engagement part that is disposed at an end on one side of the end plate, which refers to a side where the first engaged part is disposed in the width direction, and a second engagement part that is disposed at an end on an other side of the end plate, which refers a side where the second engaged part is disposed in the width direction, to be locked to the second engaged part, and wherein the cover member comprises a reinforcing plate that protrudes from an end plate part on the other side of the end plate relative to the first plate into the groove-like recessed parts and is connected to the first plate.

8. The ice making device according to claim 7, wherein the flexible member is a sheet-like or plate-like heat insulating member.

9. The ice making device according to claim 8, wherein the sheet-like heat insulating member and the plate-like heat insulating member are porous members.

10. The ice making device according to claim 7, wherein a surface of the flexible member on a side of the ice making tray has adhesiveness.

11. The ice making device according to claim 7, wherein the temperature sensor is a thermistor, and wherein the chip is a thermistor element chip.

12. An ice making device comprising:

an ice making tray in which at least one recessed part for water storage is disposed upward;

a drive unit that causes the ice making tray to perform an inversion operation and a twist operation around an axis that extends in a direction crossing a vertical direction;

a frame that supports the ice making tray and the drive unit;

a temperature sensor that is disposed to be in contact with a bottom surface of the ice making tray, wherein a sealing coating layer covering a chip for temperature detection is not covered with an exterior case and is exposed;

a flexible member covering the temperature sensor; and a cover member that is fixed to the bottom surface of the ice making tray, so that the temperature sensor is pressed against the ice making tray through the flexible member, wherein, in the ice making tray, the at least one recessed part for water storage is a plurality of recessed parts for water storage and are arranged along the axis and along a width direction crossing the axis, wherein, on the bottom surface of the ice making tray, a plurality of convex parts reflecting shape of the recessed parts for water storage are formed, and wherein the temperature sensor is disposed in one of the plurality of convex parts inside groove-like recessed parts formed between the plurality of convex parts to be in contact with a first side wall that faces a direction crossing the vertical direction, and wherein the first side wall faces the width direction, wherein the ice making tray comprises a first engaged part that protrudes from a bottom wall of the one convex part and a second engaged part that faces the first side wall in the width direction and protrudes from a bottom wall of an adjacent convex part adjacent to the one convex part, wherein the flexible member is provided so that the flexible member overlaps the bottom wall of the one of the plurality of convex parts and the first side wall, and wherein the cover member comprises an end plate that overlaps the bottom wall of the one convex part through the flexible member, a first plate that protrudes from an intermediate position on the end plate in the width direction into the groove-like recessed parts and overlaps the first side wall through the flexible member, a first engagement part that is disposed at an end on one side of the end plate, which refers to a side where the first engaged part is disposed in the width direction, and a second engagement part that is disposed at an end on an other side of the end plate, which refers a side where the second engaged part is disposed in the width direction, to be locked to the second engaged part, and wherein the flexible member is provided so that it overlaps a second side wall that is adjacent to the first side wall in the one convex part and a third side wall that is adjacent to a side opposite to the second side wall in the first side wall in the one convex part.

13. The ice making device according to claim 12, wherein the cover member comprises a second plate that overlaps the second side wall through the flexible member and a third plate that overlaps the third side wall through the flexible member.

14. The ice making device according to claim 13, wherein at least a part of the flexible member projects from between the second plate and the ice making tray and between the third plate and the ice making tray.

15. The ice making device according to claim 12, wherein the flexible member is a sheet-like or plate-like heat insulating member.

16. The ice making device according to claim 15, wherein the sheet-like heat insulating member and the plate-like insulating member are porous members.

17. The ice making device according to claim 12, wherein a surface of the flexible member on a side of the ice making tray has adhesiveness.

18. The ice making device according to claim 12, wherein the temperature sensor is a thermistor, and wherein the chip is a thermistor element chip.

* * * * *